US010910145B2

(12) United States Patent
Jeong

(10) Patent No.: US 10,910,145 B2
(45) Date of Patent: Feb. 2, 2021

(54) CHIP ELECTRONIC COMPONENT

(71) Applicant: SAMSUNG ELECTRO-MECHANICS CO., LTD., Suwon-si (KR)

(72) Inventor: Dong Jin Jeong, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/677,101

(22) Filed: Nov. 7, 2019

(65) Prior Publication Data

US 2020/0075228 A1 Mar. 5, 2020

Related U.S. Application Data

(63) Continuation of application No. 14/796,715, filed on Jul. 10, 2015, now abandoned.

(30) Foreign Application Priority Data

Sep. 18, 2014 (KR) ..... 10-2014-0124378

(51) Int. Cl.
*H01F 27/29* (2006.01)
*H01F 17/00* (2006.01)
*H01F 17/04* (2006.01)

(52) U.S. Cl.
CPC ..... *H01F 27/292* (2013.01); *H01F 17/0013* (2013.01); *H01F 2017/048* (2013.01)

(58) Field of Classification Search
CPC ..... H01F 17/0013; H01F 27/292
See application file for complete search history.

(56) References Cited

U.S. PATENT DOCUMENTS 4,392,013 A * 7/1983 Ohmura ..... H01L 21/705 174/253
6,600,404 B1 * 7/2003 Kajino ..... H01F 5/003 257/531
7,176,773 B2 2/2007 Shoji
(Continued)

FOREIGN PATENT DOCUMENTS

CN 1258777 C 6/2006
CN 102479605 A 5/2012
(Continued)

OTHER PUBLICATIONS

U.S. Final Office Action dated Aug. 7, 2019 issued in U.S. Appl. No. 14/796,715.
(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

There is provided a chip electronic component including: a magnetic body in which an internal coil part is embedded, wherein the internal coil part includes: a first coil pattern part; and a second coil pattern part formed on the first coil pattern part, when a minimum interval between adjacent coil pattern portions in the first coil pattern part is defined as a, and a maximum thickness of each coil pattern portion in the first coil pattern part is defined as b, a≤15 μm and b/a≥7 are satisfied.

8 Claims, 4 Drawing Sheets

(56) References Cited

U.S. PATENT DOCUMENTS

| | | | | |
|---|---|---|---|---|
| 7,216,419 | B2 | 5/2007 | Kusano | |
| 8,552,829 | B2 | 10/2013 | Kroener et al. | |
| 2004/0038516 | A1* | 2/2004 | Kim | H01L 21/02337 438/624 |
| 2004/0056749 | A1* | 3/2004 | Kahlmann | H01L 27/08 336/200 |
| 2004/0164835 | A1* | 8/2004 | Shoji | H01F 17/0013 336/200 |
| 2005/0140488 | A1* | 6/2005 | Shimoyama | H05K 1/165 336/200 |
| 2005/0195062 | A1* | 9/2005 | Yoshida | H01F 27/2804 336/200 |
| 2007/0235873 | A1* | 10/2007 | Cheng | G01R 1/07378 257/738 |
| 2012/0068301 | A1* | 3/2012 | Sin | H01F 27/28 257/531 |
| 2012/0126926 | A1 | 5/2012 | Kroener et al. | |
| 2012/0235779 | A1 | 9/2012 | Baram et al. | |
| 2013/0222101 | A1* | 8/2013 | Ito | H01F 5/003 336/83 |
| 2013/0236837 | A1* | 9/2013 | Honda | G03F 7/0752 430/323 |
| 2013/0249662 | A1* | 9/2013 | Tonoyama | H01F 17/0013 336/200 |
| 2013/0249664 | A1 | 9/2013 | Tonoyama et al. | |
| 2013/0300527 | A1* | 11/2013 | Kim | H01F 41/04 336/83 |
| 2014/0009254 | A1* | 1/2014 | Ohkubo | H01F 27/29 336/192 |
| 2014/0167897 | A1 | 6/2014 | Choi et al. | |
| 2015/0035640 | A1* | 2/2015 | Wang | H01F 27/2804 336/200 |

FOREIGN PATENT DOCUMENTS

| | | | |
|---|---|---|---|
| CN | 103366920 | A | 10/2013 |
| JP | H11-204337 | A | 7/1999 |
| JP | 2004-319570 | A | 11/2004 |
| JP | 2004-342645 | A | 12/2004 |
| JP | 2004-349468 | A | 12/2004 |
| JP | 3754557 | B2 | 3/2006 |
| JP | 2006-0278479 | A | 10/2006 |
| JP | 4317470 | B2 | 8/2009 |
| KR | 10-2014-0077346 | A | 6/2014 |

OTHER PUBLICATIONS

U.S. Non-Final Office Action dated Feb. 6, 2019 issued in U.S. Appl. No. 14/796,715.

U.S. Final Office Action dated Sep. 7, 2018 issued in U.S. Appl. No. 14/796,715.

U.S. Non-Final Office Action dated Jan. 24, 2018 issued in U.S. Appl. No. 14/796,715.

Notice of Office Action in corresponding Korean Patent Application No. 10-2014-0124378, dated Jun. 16, 2017 (with English translation).

Chinese First Office Action issued in corresponding Chinese Patent Application No. 201510440988.8, dated Sep. 5, 2017 (with English translation).

U.S. Final Office Action dated May 26, 2017 issued in U.S. Appl. No. 14/796,715.

U.S. Non-Final Office Action dated Nov. 16, 2016 issued in U.S. Appl. No. 14/796,715.

R. Wu, et al., "A Novel Silicon-Embedded Coreless Inductor for High-Frequency Power Management Applications," IEEE Electron Device Letters, Jan. 2011, vol. 32, No. 11, Hong Kong.

U.S. Non-Final Office Action dated May 2, 2016 issued in U.S. Appl. No. 14/796,715.

Office Action issued in corresponding Chinese Patent Application No. 201910031367.2 dated Jul. 1, 2020, with English translation.

* cited by examiner

CHIP ELECTRONIC COMPONENT

CROSS-REFERENCE TO RELATED APPLICATION

This application is a Continuation patent application of U.S. patent application Ser. No. 14/796,715, filed on Jul. 10, 2015, which claims the priority and benefit of Korean Patent Application No. 10-2014-0124378 filed on Sep. 18, 2014, the disclosures of which are incorporated herein by reference.

BACKGROUND

The present disclosure relates to a chip electronic component.

An inductor, a chip electronic component, is a representative passive element configuring an electronic circuit, together with a resistor and a capacitor to remove noise.

A thin film type inductor is manufactured by forming an internal coil part by plating, forming a magnetic body by curing a magnetic power-resin composite obtained by mixing a magnetic power and a resin with each other, and then forming external electrodes on outer surfaces of the magnetic body.

RELATED ART DOCUMENT (Patent Document 1) Japanese Patent Laid-Open Publication No. 2006-278479

SUMMARY

An aspect of the present disclosure may provide a chip electronic component having a structure in which the generation of short-circuits between coil pattern portions is prevented and a high aspect ratio (AR) by increasing a thickness of the coil pattern portion in comparison with a width thereof is realized.

According to an aspect of the present disclosure, a chip electronic component may include: a magnetic body in which an internal coil part is embedded, wherein the internal coil part includes: a first coil pattern part; and a second coil pattern part formed on the first coil pattern part, wherein when a minimum interval between adjacent coil pattern portions in the first coil pattern part is defined as a, and a maximum thickness of each coil pattern portion in the first coil pattern part is defined as b, $a \leq 15$ μm and $b/a \geq 7$ are satisfied.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
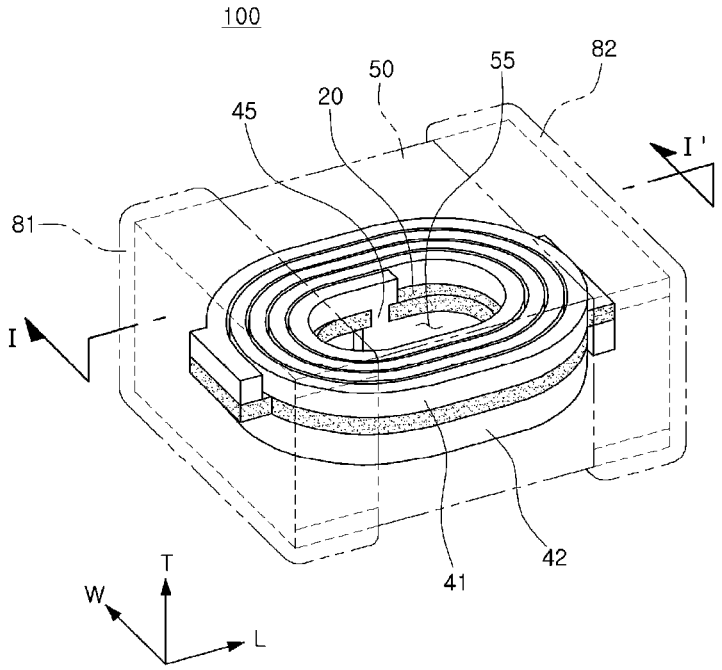
FIG. 1 is a schematic perspective view showing a chip electronic component including an internal coil part according to an exemplary embodiment of the present disclosure.

Exemplary embodiments of the present disclosure will now be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Chip Electronic Component

Hereinafter, a chip electronic component according to an exemplary embodiment of the present disclosure will be described. Particularly, a thin film type inductor will be described, but the present inventive concept is not limited thereto.

FIG. 1 is a schematic perspective view showing a chip electronic component including an internal coil part according to an exemplary embodiment of the present disclosure.

Referring to FIG. 1, as an example of the chip electronic component, a thin film type inductor used in a power line of a power supply circuit is disclosed.

The chip electronic component 100 according to an exemplary embodiment of the present disclosure may include a magnetic body 50, internal coil parts 41 and 42 embedded in the magnetic body 50, and first and second external electrodes 81 and 82 disposed on an outer portion of the magnetic body 50 to thereby be electrically connected to the internal coil parts 41 and 42.

In the chip electronic component 100 according to an exemplary embodiment of the present disclosure, a 'length' direction refers to an 'L' direction of FIG. 1, a 'width' direction refers to a 'W' direction of FIG. 1, and a 'thickness' direction refers to a 'T' direction of FIG. 1.

The magnetic body 50 may form the exterior of the chip electronic component 100 and may be formed of any material capable of exhibiting magnetic properties. For example, the magnetic body 50 may be formed by filling ferrite or magnetic metal powder.

As the ferrite, Mn—Zn based ferrite, Ni—Zn based ferrite, Ni—Zn—Cu based ferrite, Mn—Mg based ferrite, Ba based ferrite, Li based ferrite, or the like, may be used.

The magnetic metal powder may contain one or more selected from the group consisting of Fe, Si, Cr, Al, and Ni. For example, the magnetic metal powder may contain Fe—Si—B—Cr-based amorphous metal, but the present inventive concept is not necessarily limited thereto.

The magnetic metal powder may have a particle diameter of 0.1 μm to 30 μm and be contained in a form in which the magnetic metal powder is dispersed in a thermosetting resin such as an epoxy resin, polyimide, or the like.

A first internal coil part 41 having a coil shape may be formed in one surface of an insulating substrate 20 disposed in the magnetic body 50, and a second internal coil part 42 having a coil shape may be formed on the other surface opposing one surface of the insulating substrate 20.

The first and second internal coil parts 41 and 42 may be formed by performing an electroplating method.

Examples of the insulating substrate 20 may include a polypropylene glycol (PPG) substrate, a ferrite substrate, a metal-based soft magnetic substrate, and the like.

A central portion of the insulating substrate 20 may be penetrated to thereby form a hole, and a magnetic material is filled in the hole to thereby form a core part 55. As the core part 55 filled with the magnetic material is formed, inductance (Ls) may be improved.

The first and second internal coil parts 41 and 42 may be formed in a spiral shape, and the first and second internal coil parts 41 and 42 formed on one surface and the other surface of the insulating substrate 20 may be electrically connected to each other through a via 45 penetrating through the insulating substrate 20.

The first and second internal coil parts 41 and 42 and the via 45 may be formed of a metal having excellent electric conductivity. For example, the first and second internal coil parts 41 and 42 and the via 45 may be formed of silver (Ag), palladium (Pd), aluminum (Al), nickel (Ni), titanium (Ti), gold (Au), copper (Cu), platinum (Pt), a mixture thereof, or the like.

A direct current (DC) resistance (Rdc), which is one of the main characteristics of the inductor, is decreased as a cross-sectional area of an internal coil part is increased. In addition, as an area of the magnetic material through which magnetic fluxes pass, inductance of the inductor is increased.

Therefore, in order to decrease the direct current resistance (Rdc) and improve inductance, the cross-sectional area of the internal coil part and the area of the magnetic material should be increased.

As a method of increasing the cross-sectional area of the internal coil part, there are a method of increasing a width of a coil pattern portion and a method of increasing a thickness of the coil pattern portion.

However, in the case of increasing the width of the coil pattern portion, a risk that a short-circuit will be generated between the coil pattern portions may be increased, there may be a limitation in turns in the chip electronic component, which cause a decrease in the area of the magnetic material, such that efficiency may be decreased, and there is a limitation in forming a high inductance product.

Therefore, an internal coil part having a high aspect ratio (AR) by increasing the thickness of the coil pattern portion without increasing the width of the coil pattern portion has been required.

The aspect ratio (AR) of the internal coil part is a value obtained by dividing the thickness of the coil pattern portion by the width of the coil pattern portion, and as an increase in the thickness of the coil pattern portion is further increased than an increase in the width of the coil pattern portion, the aspect ratio (AR) may also be increased.

However, at the time of performing the electroplating method, as the plating proceeds, due to isotropic growth, that is, simultaneous growth of the coil pattern portions in the thickness direction and in the width direction, a short-circuit may be generated between the coil pattern portions and it may be difficult to form an internal coil part having a high aspect ratio (AR).

Therefore, according to an exemplary embodiment of the present disclosure, the internal coil part having a high aspect ratio (AR) may be formed by adjusting a shape of a primary coil pattern part forming the internal coil part as described below.

Figure 2:
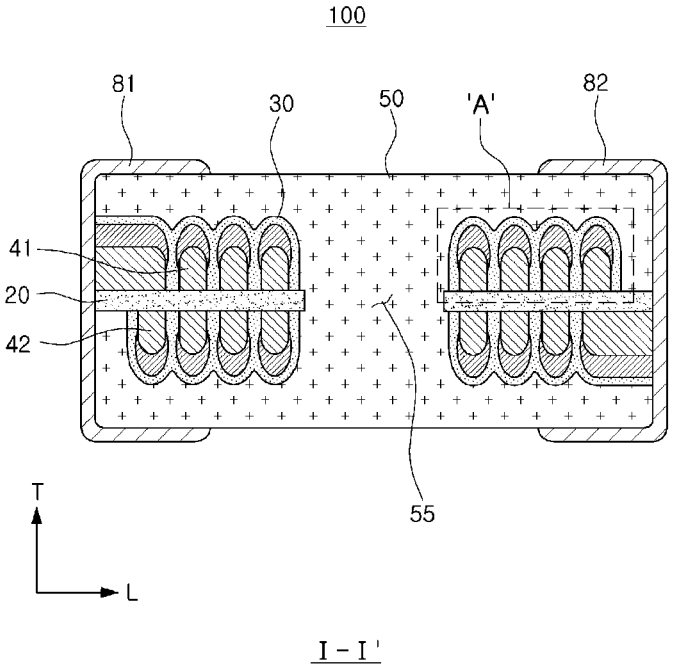
FIG. 2 is a cross-sectional view taken along line I-I' of FIG. 1.

FIG. 2 is a cross-sectional view taken along line I-I' of FIG. 1.

Referring to FIG. 2, each of the first and second internal coil parts 41 and 42 may include a first coil pattern part 61 formed on the insulating substrate 20 and a second coil pattern part 62 formed on the first coil pattern part 61.

Figure 3:
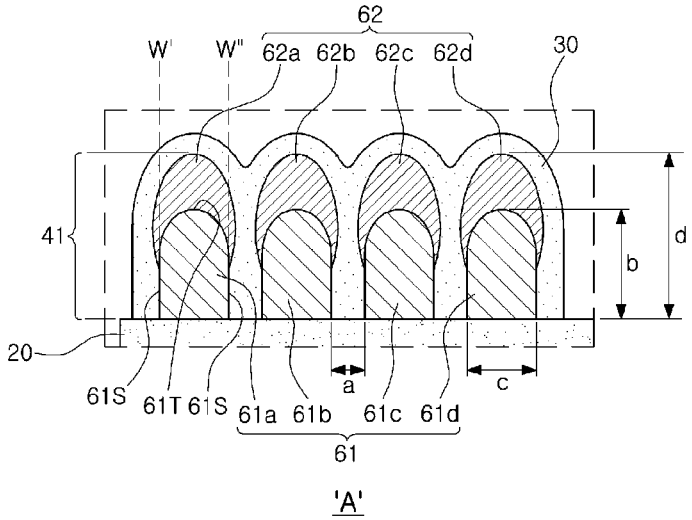
FIG. 3 is an enlarged schematic view of an example of part 'A' of FIG. 2.

FIG. 3 is an enlarged schematic view of an example of part 'A' of FIG. 2.

Referring to FIG. 3, in the first coil pattern part 61 according to an exemplary embodiment of the present disclosure, when a minimum interval between adjacent coil pattern portions 61*a*, 61*b*, 61*c*, and 61*d* forming the first coil pattern part 61 is defined as a, a may be 15 μm or less (a≤15 μm).

Further, when a maximum thickness of the coil pattern portions 61*a*, 61*b*, 61*c*, and 61*d* forming the first coil pattern part 61 is defined as b, b/a may be 7 or more (b/a≥7).

The first coil pattern part 61 may be formed by a pattern plating method of forming a plating resist patterned through an exposure and development process on the insulating substrate 20 and filling an opening part by plating.

At the time of forming the second coil pattern part 62 by electroplating using the first coil pattern part 61 as a seed layer, anisotropic plating growth that growth of the coil pattern portions in the width direction is suppressed but growth of the coil pattern portions in the thickness direction is performed may be induced by forming the first coil pattern part 61 to satisfy a≤15 μm and b/a≥7.

Therefore, as shown in FIG. 3, coil pattern portions 62*a*, 62*b*, 62*c*, and 62*d* of the second coil pattern part 62 may be formed on the coil pattern portions 61*a*, 61*b*, 61*c*, and 61*d* of the first coil pattern part 61 so that side surfaces 61S of the coil pattern portions 61*a*, 61*b*, 61*c*, and 61*d* are not covered.

Upper surfaces 61T of the coil pattern portions 61*a*, 61*b*, 61*c*, and 61*d* of the first coil pattern part 61 may refer to, for example, a surface of an upper portion of the coil pattern portion 61*a* based on virtual lines W' and W" extended from the width of the coil pattern portion 61*a*.

In addition, side surfaces 61S of the coil pattern portions 61*a*, 61*b*, 61*c*, and 61*d* of the first coil pattern part 61 may refer to, for example, a surface of a side portion of the coil pattern portion 61*a* based on the virtual lines W' and W" extended from the width of the coil pattern portion 61*a*.

The first coil pattern part 61 is formed to satisfy a≤15 μm and b/a≥7, anisotropic plating of the second coil pattern part 62 may be induced, such that the second coil pattern part 62 may not be formed on portions of the side surfaces 61S of the coil pattern portions 61*a*, 61*b*, 61*c*, and 61*d* of the first coil pattern part 61 instead of being formed so as to cover all of the side surfaces 61S of the coil pattern portions 61*a*, 61*b*, 61*c*, and 61*d* of the first coil pattern part 61.

That is, the coil pattern portions 62*a*, 62*b*, 62*c*, and 62*d* of the second coil pattern part 62 may be formed as anisotropic plating layers grown on the upper surfaces 61T of the coil pattern portions 61*a*, 61*b*, 61*c*, and 61*d* of the first coil pattern part 61 in the thickness direction in a state in which growth thereof in the width direction is suppressed.

The second coil pattern part 62 is anisotropically grown by plating, such that generation of the short-circuit between the coil pattern portions may be prevented, and the internal coil parts 41 and 42 having a high aspect ratio may be obtained. In addition, high inductance may be obtained by increasing a volume of the core part 55 while decreasing direction current resistance (Rdc).

In the case in which a of the first coil pattern part 61 is more than 15 μm, or b/a is less than 7, the second coil pattern part 62 is isotropically grown, that is, the second coil pattern part 62 is simultaneously grown in the thickness direction and the width direction, such that a short-circuit may be generated between the coil pattern portions, and the aspect ratio of the internal coil part may be decreased.

A maximum width c of the coil pattern portions 61*a*, 61*b*, 61*c*, and 61*d* of the first coil pattern part 61 may be 50 μm to 90 μm.

A thickness d of the internal coil parts 41 and 42 including the first and second coil pattern parts 61 and 62 may be 200 μm to 500 μm.

The first and second coil pattern parts 61 and 62 may be formed of a metal having excellent electric conductivity, respectively. For example, the first and second coil pattern parts 61 and 62 may be formed of silver (Ag), palladium (Pd), aluminum (Al), nickel (Ni), titanium (Ti), gold (Au), copper (Cu), platinum (Pt), an alloy thereof, or the like.

The first and second coil pattern parts 61 and 62 may be formed of the same metal as each other, and most preferably, may be formed of copper (Cu).

The internal coil parts 41 and 42 according to an exemplary embodiment of the present disclosure are formed so that the first coil pattern part 61 satisfies a≤15 μm and b/a≥7, such that generation of the short-circuit between the coil patterns may be prevented and the internal coil parts 41 and 42 having a high aspect ratio (AR) may be obtained by inducing the anisotropic plating growth of the second coil pattern part 62. For example, the internal coil parts 41 and 42 may have an aspect ratio (AR) of 2.0 or more.

Figure 4:
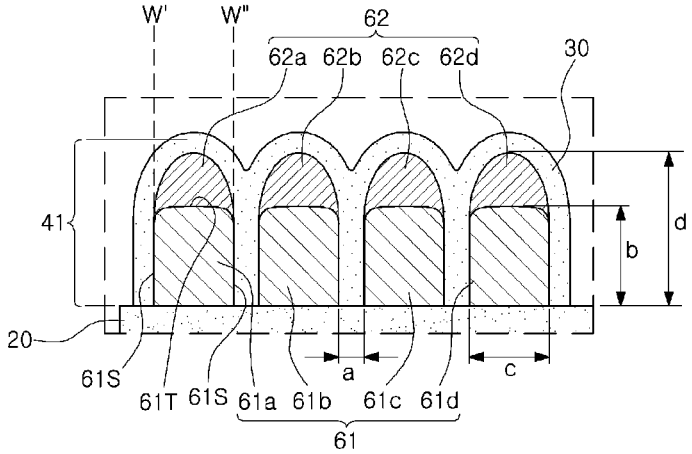
FIG. 4 is an enlarged schematic view of another example of part 'A' of FIG. 2.

FIG. 4 is an enlarged schematic view of another example of part 'A' of FIG. 2.

Referring to FIG. 4, upper surfaces 61T of coil pattern portions 61*a*, 61*b*, 61*c*, and 61*d* of a first coil pattern part 61 in another example of the present disclosure may have a flat structure, and a cross section of each of the coil pattern portions 61*a*, 61*b*, 61*c*, and 61*d* may have a tetragonal shape.

Although the case in which the upper surfaces 61T of the coil pattern portions 61*a*, 61*b*, 61*c*, and 61*d* of the first coil pattern part 61 have a convex shape is shown in FIG. 3, and the case in which the upper surfaces 61T have a flat shape is shown in FIG. 4, the present inventive concept is not necessarily limited thereto.

The cross-sectional shape of the coil pattern portions 61*a*, 61*b*, 61*c*, and 61*d* of the first coil pattern part 61 may be various changed in a range in which those skilled in the art may apply the present disclosure as long as the minimum interval a between the coil pattern portions 61*a*, 61*b*, 61*c*, and 61*d* of the first coil pattern part 61 is 15 μm or less, and in relation with the maximum thickness b between the coil pattern portions 61*a*, 61*b*, 61*c*, and 61*d* of the first coil pattern part 61, b/a is 7 or more.

The internal coil parts 41 and 42 may be covered with an insulation film 30.

The insulation film 30 may be formed by a method known in the art such as a screen printing method, an exposure and development process of a photo resist (PR), a spray application method, or the like. The internal coil parts 41 and 42 may be covered with the insulation film 30, such that the internal coil parts 41 and 42 may not directly come in contact with the magnetic material configuring the magnetic body 50.

One end portion of the first internal coil part 41 formed on one surface of the insulating substrate 20 may be exposed to one end surface of the magnetic body 50 in the length (L) direction, and one end portion of the second internal coil part 42 formed on the other surface of the insulating substrate 20 may be exposed to the other end surface of the magnetic body 50 in the length (L) direction.

The first and second external electrodes 81 and 82 may be disposed on both end surfaces of the magnetic body 50 in the length (L) direction so as to be connected to the first and second internal coil parts 41 and 42 exposed to both end surfaces of the magnetic body 50 in the length (L) direction, respectively.

The first and second external electrodes 81 and 82 may be formed of a metal having excellent electric conductivity. For example, the first and second external electrodes 81 and 82 may be formed of one of nickel (Ni), copper (Cu), tin (Sn), silver (Ag), and the like, an alloy thereof, or the like.

The first and second external electrodes 81 and 82 may include, for example, conductive resin layers and plating layers formed on the conductive resin layers. The conductive resin layer may contain one or more conductive metals selected from the group consisting of copper (Cu), nickel (Ni), and silver (Ag) and a thermosetting resin. The plating layer may contain one or more selected from the group consisting of nickel (Ni), copper (Cu), and tin (Sn). For example, nickel (Ni) layers and tin (Sn) layers may be sequentially formed.

The following Table 1 shows results obtained by measuring plating growth of the second coil pattern part 62 formed on the first coil pattern part 61 by electroplating while changing a (a minimum interval between coil pattern portions) and b (a maximum thickness of the coil pattern portion) of the first coil pattern part 61.

Growth of an upper portion of the second coil pattern part 62 means a thickness of the second coil pattern part 62 formed on the upper surface 61T of the first coil pattern part 61, and growth of a side portion of the second coil pattern part 62 means a thickness of the second coil pattern part 62 formed on the side surface 61S of the first coil pattern part 61.

TABLE 1

| | a(μm) | b(μm) | b/a | Growth of Upper Portion(μm) | Growth of Side Portion (μm) |
|---|---|---|---|---|---|
| *1 | 30 | 30 | 1 | 10 | 10 |
| *2 | 30 | 70 | 2.3 | 10 | 10 |
| *3 | 30 | 150 | 5 | 10 | 7 |
| *4 | 20 | 30 | 1.5 | 10 | 10 |
| *5 | 20 | 70 | 3.5 | 10 | 10 |
| *6 | 20 | 150 | 7.5 | 15 | 5 |
| *7 | 15 | 30 | 2 | 10 | 10 |
| *8 | 15 | 70 | 5 | 10 | 8 |
| 9 | 15 | 150 | 10 | 20 | 0 |
| *10 | 10 | 30 | 3 | 5 | 5 |
| 11 | 10 | 70 | 7 | 10 | 0 |
| 12 | 10 | 150 | 7 | 10 | 0 |

(*Comparative Example)

As shown in Table 1, when the first coil pattern part 61 simultaneously satisfied a≤15 μm and b/a≥7, anisotropic plating growth that growth of the side portion of the second coil pattern part 62 formed on the first coil pattern part 61 was suppressed and the growth of the upper portion thereof was performed was induced.

Therefore, generation of the short-circuit between the coil pattern portions may be prevented, the internal coil parts 41 and 42 having a high aspect ratio (AR) may be formed, and high inductance may be obtained by increasing the volume of the core part 55 while decreasing the direct current resistance (Rdc).

As set forth above, according to exemplary embodiments of the present disclosure, the internal coil part capable of preventing generation of the short-circuit between the coil pattern portions and having a high aspect ratio (AR) may be obtained by increasing the thickness of the coil pattern portion in comparison with the width thereof.

While exemplary embodiments have been shown and described above, it will be apparent to those skilled in the art that modifications and variations could be made without departing from the scope of the present invention as defined by the appended claims.

What is claimed is:

1. A chip electronic component comprising:

an insulating substrate;

a first coil pattern part disposed directly on the insulating substrate; and a second coil pattern part disposed on an upper surface of the first coil pattern part, wherein when a minimum interval between adjacent coil pattern portions in the first coil pattern part is defined as a, and a maximum thickness of each coil pattern portion in the first coil pattern part is defined as b, $a \leq 15$ μand $b/a \geq 7$ are satisfied, the first coil pattern part includes a first portion disposed directly on the insulating substrate and a second portion extending from the first portion, a width of the second portion is smaller than a width of the first portion, the second coil pattern part is disposed on the second portion, and the second coil pattern part is not disposed on a side surface of the first portion.

2. The chip electronic component of claim 1, further comprising a magnetic body in which an internal coil part including the first and second coil pattern parts is embedded, wherein the magnetic body contains a magnetic metal powder.

3. The chip electronic component of claim 1, wherein the insulating substrate has a through hole which is disposed in a central portion of the insulating substrate, and the through hole is filled with a magnetic material to form a core part.

4. The chip electronic component of claim 1, wherein the first coil pattern part is disposed on one surface of the insulating substrate and the other surface of the insulating substrate opposing the one surface thereof to form electrical connections therebetween through a via.

5. The chip electronic component of claim 1, wherein the first and second coil pattern parts contain one or more selected from the group consisting of silver (Ag), palladium (Pd), aluminum (Al), nickel (Ni), titanium (Ti), gold (Au), copper (Cu), and platinum (Pt).

6. The chip electronic component of claim 1, wherein the width of the second portion decreases from the first portion to a top portion of the second portion.

7. The chip electronic component of claim 1, wherein a curvature of an upper surface of the first coil pattern part is different than a curvature of an upper surface of the second coil pattern part.

8. The chip electronic component of claim 1, further comprising an insulation film disposed directly on the insulating substrate and between the adjacent coil pattern portions.

* * * * *